US005433436A

United States Patent [19]

Hoyt et al.

[11] Patent Number: 5,433,436

[45] Date of Patent: Jul. 18, 1995

[54] TEE AND BALL MARKER CLIP ON HOLDER

[75] Inventors: David Hoyt, Gardena; David Aldcroft, Long Beach, both of Calif.

[73] Assignee: Principle Plastics, Inc., Gardena, Calif.

[21] Appl. No.: 289,934

[22] Filed: Aug. 12, 1994

[51] Int. Cl.[6] ..... A63B 57/00

[52] U.S. Cl. ..... 273/32 B; 273/32 A; 273/32 D; 224/918; 206/315.1

[58] Field of Search ..... 273/195 R, 33, 32 A, 273/32 B, 32 D; 224/256, 269, 918, 163, 904; 206/315.1; 36/114, 127

[56] References Cited

U.S. PATENT DOCUMENTS

| | | | |
|---|---|---|---|
| 3,819,095 | 6/1974 | Snyder | 224/918 |
| 4,475,676 | 10/1984 | Smith | 273/32 B |
| 4,736,877 | 4/1988 | Clark | 273/32 D |
| 4,886,196 | 12/1989 | Plummer | 224/918 |
| 4,960,239 | 10/1990 | Wait | 273/32 D |
| 5,305,999 | 4/1994 | Tate | 273/32 B |

*Primary Examiner*—Vincent Millin
*Assistant Examiner*—William M. Pierce
*Attorney, Agent, or Firm*—John J. Connors; Connors & Associates

[57] ABSTRACT

Disclosed is a golf device 10 holding tees and a divot repair tool 18. The device 10 can be conveniently attached to the side 12 of a golf shoe 14. It includes a clip member 20 that attaches to the shoe 14 and carries the divot repair tool 18. The clip member 20 includes tee-holding elements 40 which hold conventional golf tees.

10 Claims, 2 Drawing Sheets

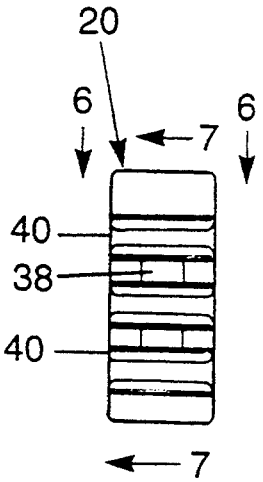
Fig. 5
Fig. 6
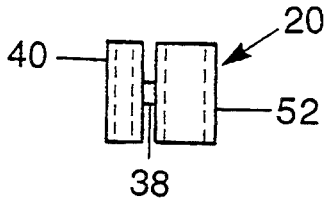
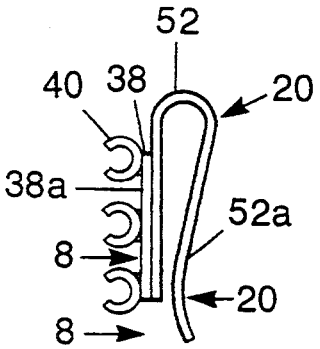
Fig. 7
Fig. 8
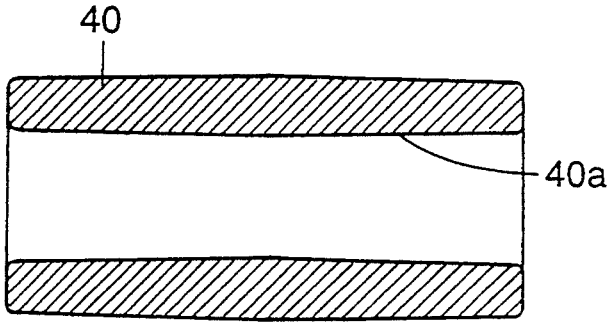

TEE AND BALL MARKER CLIP ON HOLDER

BACKGROUND OF THE INVENTION

1. Field of the Invention

This invention relates to a golf device, and in particular, one which can be conveniently attached to the side of a golf shoe, a belt, and the like. The device includes a tool for repairing divots removably mounted to a clip member that attaches to the golf shoe, a belt, and the like. The clip member includes tee-holding elements which hold conventional golf tees.

2. Background Discussion

When playing golf, it is desirable to repair divots, especially the divots made in greens. The conventional tool for accomplishing this is a metal, blade-like fork having two spaced apart fingers with a handle opposite the fingers. Golfers also like to keep tees in an easy to access location rather than in their pockets. A ball marker is also frequently used to locate the position of a golf ball on the green. Typical markers include a disk-like head having a central, outwardly extending pin. The golfer simply picks up the ball and places the ball marker in the exact spot where the ball was by pressing the pin into the green with the head showing the location of the ball.

SUMMARY OF THE INVENTION

It is the objective of this invention to provide a device, attachable to a golf shoe, a belt, and the like, which holds a divot repair tool, tees, and, optionally, a ball marker.

The device of this invention has several features, no single one of which is solely responsible for its desirable attributes. Without limiting the scope of this invention as expressed by the claims which follow, its more prominent features will now be discussed briefly. After considering this discussion, and particularly after reading the section entitled, "DETAILED DESCRIPTION OF THE PREFERRED EMBODIMENT," one will understand how the features of this invention provide its benefits, which include convenience and simplicity of use, and low cost manufacture.

The first feature of this invention is that the golf device of this invention is adapted to be removably attached to a golf shoe, a belt, and the like. The device has a divot repair tool detachably connected to a clip member attachable to the golf shoe, a belt, and the like. The divot repair tool has a rigid, blade-like body with a handle at one end and a pair of spaced fingers extending outward from the handle. The fingers are spaced apart a predetermined distance and are generally parallel to each other. The handle preferably is made from a resilient material such as, for example, rubber by insert molding to the blade-like body, and preferably has an orifice therein adapted to receive a pin element of a ball marker.

The second feature is that the clip member is configured so that the divot repair tool may easily slide on and off the clip member. Preferably, the clip member is made from an injection moldable resilient plastic material. The clip member includes a rectangular shaped bar element having a width about equal to the predetermined bar element between the fingers. This enables the divot repair tool to be removably attached to the clip member by sliding the blade-like body over the bar element with the fingers straddling the bar element.

The third feature is that the bar element holds tees. The bar element has a front section which faces outward when the device is attached to a golf shoe, a belt, and the like and a back section. A plurality of golf tee holding elements are mounted to the front section of the bar element, and a hook member is attached to the back section of the bar element. The hook member enables the clip member to be removably attached to a side wall of the golf shoe, a belt, and the like.

The fourth feature is that the tee holding elements are side by side in a row. These tee holding elements are each adapted to hold an individual golf tee so that, when placed in one of said tee holding elements, each tee is generally parallel to an adjacent tee. Each tee holding elements preferably has a generally C-shaped cross-section. The tee holding elements are generally horizontal when the device is attached to the golf shoe, a belt, and the like.

DESCRIPTION OF THE DRAWING

The preferred embodiment of this invention, illustrating all its features, will now be discussed in detail. This embodiment depicts the novel and non-obvious device of this invention shown in the accompanying drawing, which is for illustrative purposes only. This drawing includes the following figures (FIGS.), with like numerals indicating like parts:

FIG. 5 is a front elevational view of the clip member of the device of this invention.

FIG. 6 is a cross sectional view taken along line 6—6 of FIG. 5.

FIG. 7 is a cross sectional view taken along line 7—7 of FIG. 5.

FIG. 8 is a cross sectional view taken along line 8—8 of FIG. 7.

DETAILED DESCRIPTION OF THE PREFERRED EMBODIMENT

Figure 1:
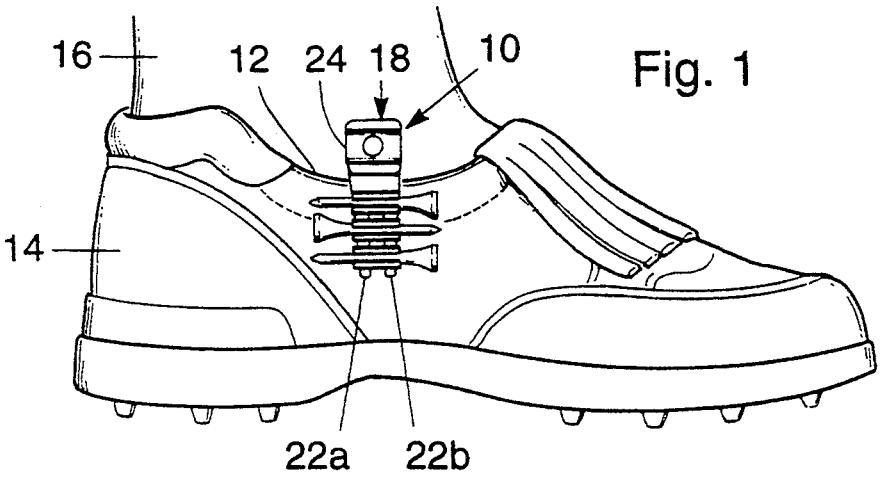
FIG. 1 is a side elevational view showing the golf device of this invention attached to the side wall of a golf shoe.
Figure 2:
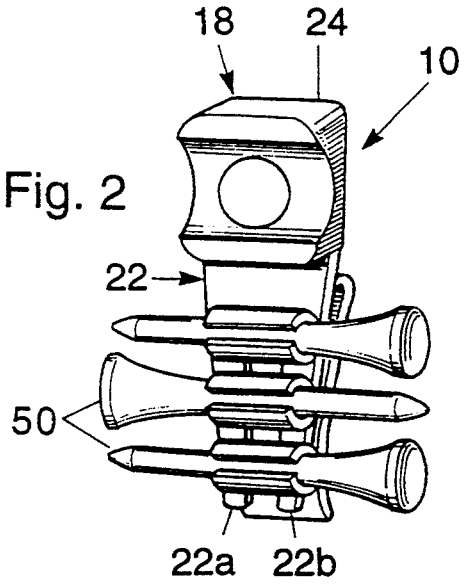
FIG. 2 is a perspective view of the assembled golf device of this invention including a divot repair tool and a clip member.
Figure 3:
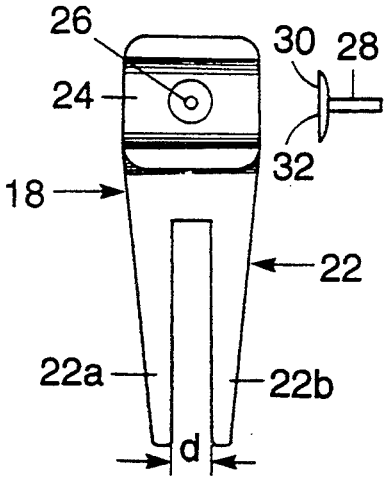
FIG. 3 is a front elevational view of the divot repair tool.
Figure 4:
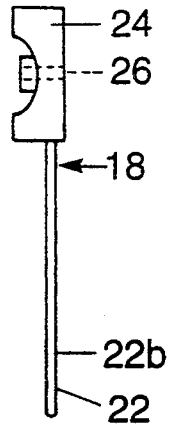
FIG. 4 is a side elevational view of the divot repair tool shown in FIG. 3 with a ball marker position to be inserted into the handle of the tool.

As best illustrated in FIGS. 1 and 2, the golf device 10 of this invention is adapted to be removably attached to the side wall 12 of a golf shoe 14 near where a golfer puts his foot 16 into the shoe. The device 10 includes a divot repair tool 18 as best shown in FIGS. 3 and 4 and a clip member 20 is best shown in FIGS. 5 through 7. The divot repair tool 18 and clip member 20 are adapted to be removably connected together as shown in FIG. 2.

The divot repair tool 18 includes a blade-like fork element 22. There is at one end of the blade-like fork element 22 a handle 24 and a pair of fingers **22*a* and 22*b* extending outwardly from the handle 24. The fingers 22*a* and 22*b* are parallel to each other and are spaced apart at a distance d which is uniform along the length of the fingers 22*a* and 22*b*. The fingers 22*a* and 22*b* are slipped over the clip member 20 so that the clip member 20 will carry the divot repair tool 18, but allow the user to remove the divot repair tool from the clip member without removing the device 10 from the shoe 14. The handle 24 has an orifice 26 centrally located which receives the pin 28 of a ball marker 30. The pin 28 is centrally located and extends outward from a disk shaped head 32 of the ball marker 30. Preferably, the blade-like fork element 22 is made of hardened-steel and the handle 24** is a rubber material which has been insert injection molded onto the blade.

The clip member 20 is preferably made of ABS plastic resin material. Consequently, it has an inherent resiliency, so that it is spring biased. The clip member 20 includes a bar 38 which has a width about equal to the distance between the fingers 22*a* and 22*b*. This bar 38 has an outer face 38*a* to which are attached three parallel, tee-holding members 40. The tee-holding members 40 have a generally C-shaped cross section and are not uniform in diameter. As best shown in FIG. 8, the central inside portion 40*a* of each tee-holding member 40 has a diameter slightly less than the outer end portions of these members. Thus, the inside walls taper inwardly towards the center. When a tee 50 is forced into one tee-holding member 40, the C-shaped, tee-holding member expands outwardly slightly and is biased like a spring to grip the tee firmly. Connected to the back side of the bar 38 is a hook 52. The hook 52 loops around and has a inwardly biased arm 52*a* which is spring-biased. Thus, when the hook 52 is slipped over the side wall 12 of the shoe 14, the arm 52*a* moves outwardly slightly, gripping the side wall.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiment disclosed. On the contrary, the intention is to cover all modifications and alternate constructions coming within the spirit and scope of the invention as generally expressed by the following claims, which particularly point out and distinctly claim the subject matter of the invention.

We claim:

1. A golf tool adapted to be removably attached to a golf shoe, a belt, and the like, including a divot repair tool, a clip member adapted to be removably attached to said shoe, belt, and the like, said divot repair tool and clip member being detachably connected together, said divot repair tool having a rigid, blade-like body with a handle at one end and a pair of spaced fingers extending outward from the handle, said fingers being spaced apart a predetermined distance and being generally parallel to each other, said clip member being made of a resilient material and including a bar element having a width about equal to said predetermined distance, said bar element providing a support structure for said divot repair tool to enable said divot repair tool to be removably attached to the clip member by sliding the blade-like body over the bar element with the fingers straddling said bar element, said bar element having a front section which faces outward when the tool is attached to a golf shoe, a belt, and the like and a back section, a plurality of golf tee holding elements mounted to the front section of the bar element, and a hook member attached to the back section of the bar element that enables the clip member to be removably attached to a sidewall of a golf shoe.

2. The tool of claim 1 where the handle has an orifice therein adapted to receive a pin element of a ball marker.

3. The tool of claim 1 where the clip member is made of a plastic material.

4. The tool of claim 1 where the tee holding elements are side by side in a row, said tee holding elements each being adapted to hold an individual golf tee so that, when placed in one of said tee holding elements, each tee is generally parallel to an adjacent tee.

5. The tool of claim 4 where each tee holding elements has a generally C-shaped cross-section.

6. The tool of claim 5 where the tee holding elements are generally perpendicular to the bar element when the tool is attached to said golf shoe, a belt, and the like.

7. The tool of claim 1 where each tee holding elements has a generally C-shaped cross-section.

8. A golf tool adapted to be removably attached to a golf shoe, a belt, and the like, including a divot repair tool, a clip member adapted to be removably attached to said golf shoe, a belt, and the like, said divot repair tool and clip member being detachably connected together, said divot repair tool having a rigid, blade-like body with a handle at one end and a pair of spaced fingers extending outward from the handle, said fingers being spaced apart a predetermined distance and being generally parallel to each other, said handle having an orifice therein adapted to receive a pin element of a ball marker, said clip member being made of a resilient material and including a bar element having a width about equal to said predetermined distance, said bar element providing a support structure for said divot repair tool to enable said divot repair tool to be removably attached to the clip member by sliding the blade-like body over the bar element with the fingers straddling said bar element, said bar element having a front section which faces outward when the tool is attached to a golf shoe, a belt, and the like and a back section, a plurality of golf tee holding elements mounted to the front section of the bar element, said tee holding elements being side by side in a row and being generally horizontal when the tool is attached to said golf shoe, a belt, and the like, each tee holding element being adapted to hold an individual golf tee so that, when placed in one of said tee holding elements, each tee is generally parallel to an adjacent tee, and a hook member attached to the back section of the bar element that enables the clip member to be removably attached to a golf shoe, a belt, and the like.

9. The tool of claim 8 where the clip member is made of a plastic material.

10. A golf tool adapted to be removably attached to a golf shoe, a belt, and the like, including a divot repair tool, and a clip member adapted to be removably attached to said golf shoe, a belt, and the like, said divot repair tool and clip member being detachably connected together, said divot repair tool having a rigid, blade-like body with a pair of outward extending fingers spaced apart a predetermined distance and being generally parallel to each other, said clip member including a bar element having a width about equal to said predetermined distance, said bar element providing a support structure for said divot repair tool to enable said divot repair tool to be removably attached to the clip member by sliding the blade-like body over the bar element with the fingers straddling said bar element, and a plurality of golf tee holding elements mounted to the clip member.

* * * * *